United States Patent [19]

Cobb

[11] 3,941,059

[45] Mar. 2, 1976

[54] FLECHETTE

[75] Inventor: Donald R. Cobb, Evansville, Ind.

[73] Assignee: The United States of America as represented by the Secretary of the Army, Washington, D.C.

[22] Filed: Jan. 18, 1967

[21] Appl. No.: 611,534

[52] U.S. Cl. ..... 102/91; 102/DIG. 7; 273/95 R

[51] Int. Cl.[2] ..... F42B 11/10

[58] Field of Search ..... 273/95; 102/91, DIG. 7, 102/62, 92.2, 92.3, 92.4, 92.6

[56] References Cited

UNITED STATES PATENTS

| | | | |
|---|---|---|---|
| 1,135,357 | 4/1915 | Clyne | 102/91 |
| 1,195,107 | 8/1916 | Sheriff | 102/38 UX |
| 2,661,694 | 12/1953 | Allen et al. | 102/91 |
| 3,033,116 | 5/1962 | Critcher et al. | 102/93 |
| 3,097,603 | 7/1963 | Harper | 102/91 |
| 3,138,102 | 6/1964 | Meyer et al. | 102/91 |

*Primary Examiner*—Samuel Feinberg

*Attorney, Agent, or Firm*—Nathan Edelberg; Robert P. Gibson; A. Victor Erkkila

[57] ABSTRACT

This invention comprehends an improved flechette structure having means for turning back split forward portions thereof upon the striking of the target thereby to increase the wound capabilities of the flechette. The flechette structure includes a one-piece member defining both the penetrating nose portion and flight stabilizing fin portion of the flechette. The nose portion is split and a wedge element is disposed therein for effecting the turning back of the nose portion as a result of the striking of the target. The wedging element may further define at least a portion of the penetrating nose of the flechette.

14 Claims, 14 Drawing Figures

INVENTOR
DONALD R. COBB
BY Hofgren, Wegner, Allen, Stellman & McCord.
ATTORNEYS.

FLECHETTE

This invention relates to flechettes and in particular to flechettes adapted to inflict wounds on target personnel.

In one known form of flechette for inflicting a wound, the flechette defines an elongated member having a pointed nose end adapted to penetrate the target. Means are associated with the tail end of the elongated member for orienting the flechette with the nose end foremost in flight to effect the penetration of the target by the nose end. The present invention comprehends an improved flechette structure having a split front nose end arranged to bend outwardly upon impact with the target thereby to provide increased wound capabilities.

Thus, a principal feature of the present invention is the provision of a new and improved flechette.

Another feature of the invention is the provision of such a flechette having a split nose end and means for separating the portions of the nose end as an incident of the striking of the target thereby to increase the wound capabilities thereof.

A further feature of the invention is the provision of such a flechette having new and improved means for wedging apart the split portions of the nose end as an incident of the striking of the target.

A yet further feature of the invention is the provision of such a flechette having new and improved means associated with the split portions for weakening the connection of the portions to the remainder of the flechette whereby the portions may become separated therefrom to provide a plurality of target penetration channels.

A further feature of the invention is the provision of such a flechette having new and improved wedging means defining the forward tip of the nose end.

Still another feature of the invention is the provision of such a flechette wherein the wedging means comprises a body of material preselected to be injurious to the target.

Another feature of the invention is the provision of such a flechette wherein the nose end is provided with a diametric slot to define a bifurcated, deflectable prong structure.

Other features and advantages of the invention will be apparent from the following description taken in connection with the accompanying drawing wherein.

Figure 13:
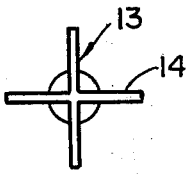
FIG. 13 is a rear end view illustrating the vaned tail end of the flechettes.

In the exemplary embodiment of the invention as disclosed in FIGS. 1 through 4 of the drawing, a flechette generally designated 10 is shown to comprise an elongated member 11 having a nose end 12 and a tail end 13. The tail end, as shown in FIG. 13, may comprise a plurality of radially extending fins 14 for stabilizing the flight of the flechette and orienting the flechette with the nose end 12 in a forward direction in flight.

Figure 1:
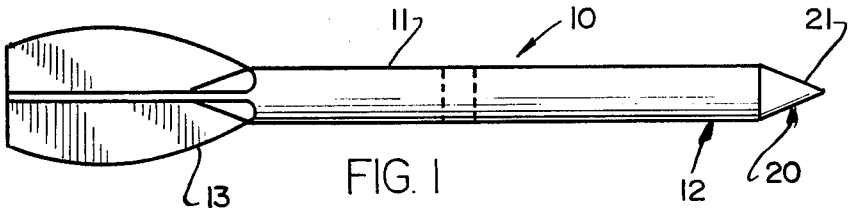
FIG. 1 is a side elevation of a flechette embodying the invention.
Figure 2:
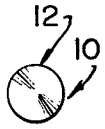
FIG. 2 is a front end elevation thereof.
Figure 3:
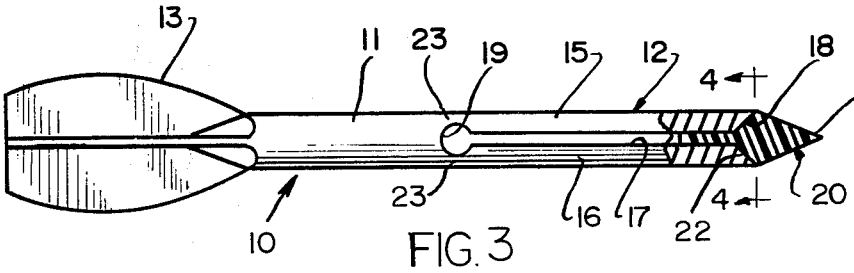
FIG. 3 is a top plan view thereof with a portion thereof shown in horizontal diametric section.
Figure 4:
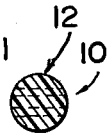
FIG. 4 is a transverse section thereof taken substantially along line 4—4 of FIG. 3.

The present invention, as indicated briefly above, comprehends a novel construction of the nose end 12 whereby a plurality of target penetration channels are created as a result of the striking of the target by the flechette. More specifically, as best seen in FIG. 3, the nose end 12 of the flechette is bifurcated to define a pair of prongs 15 and 16 spaced by a diametric slot 17. The front end of the slot 17 defines a forwardly opening recess 18, and the rear end of the slot 17 terminates in a diametric bore 19. A wedging element generally designated 20 is disposed in the slot 17, and the recess 18 extends forwardly therefrom to define a sharp point 21 defining the forward tip of the flechette. The element 20 defines a wedging surface 22 confronting the nose end 12 of the member 11 in the recess 18. Thus, when the tip 21 strikes a target the surface 22 is urged rearwardly against the nose end 12 of the member 11 and causes the prong portions 15 and 16 to spread apart and thereby define a pair of diverging channels extending away from the longitudinal axis of the flechette defining the main channel of penetration.

The thickness of the portions 23 of the member 11 adjacent through bore 19 is relatively small, and thus portions 23 define fracture zones whereat the prongs 15 and 16 may separate from the elongated member 11 as a result of the directing of the prongs in outwardly diverging channels through the target as initiated by the wedging element 20.

The wedging element 20 may be provided in different forms, as shown in the embodiment of FIGS. 5 through 12. Thus, in the flechette generally designated 110 shown in FIG. 5, a wedging element 120 is shown to comprise a body of material received in the slot 117, recess 118 and through bore 119 which as the result of the striking of a target is compressed rearwardly in the slot 117 to initiate the spreading apart of the prongs 115 and 116. The wedging element 120 may comprise a material preselected to be injurious to the target upon contact therewith such as lethal of paralyzing material where the flechette is adapted for striking target personnel.

Figure 7:
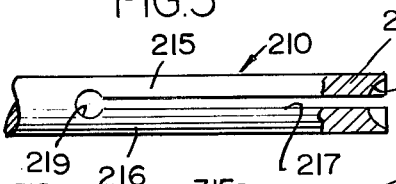
FIG. 7 is a fragmentary top plan view of another modified form of flechette.

In FIG. 7, a flechette generally designated 210 is shown to comprise a flechette similar to flechette 10, but wherein the wedging element is omitted. The recess 218 at the forward end of the slot 217 is adapted to wedge the prong portions 215 and 216 apart as an incident of a striking of the target by the nose end 212 defined by the recess 218.

Figure 9:
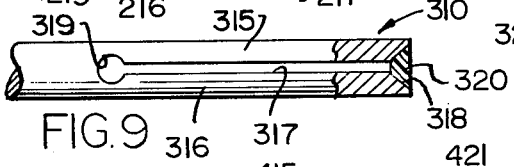
FIG. 9 is a fragmentary top plan view of still another modified form of flechette embodying the invention.
Figure 11:
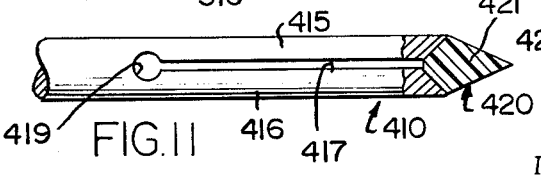
FIG. 11 is a fragmentary top plan view of yet another modified form of flechette embodying the invention.

In FIG. 9, a flechette generally designated 310 is shown to comprise a flechette similar to that of FIG. 7, but having a short element 320 received in the recess 318. In FIG. 11, a flechette generally designated 410 is shown to comprise a flechette similar to flechette 310, but wherein the wedge element 420 includes a forward tip portion 421.

Figure 5:
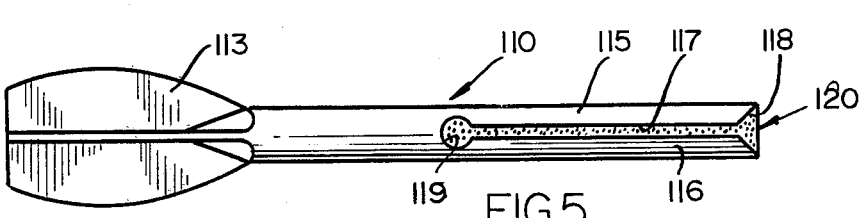
FIG. 5 is a top plan view of a modified form of flechette embodying the invention.
Figure 6:
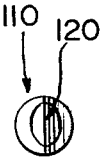
FIG. 6 is a front end view of the embodiment of FIG. 5.
Figure 8:
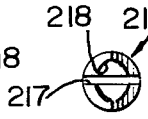
FIG. 8 is a front end view of the embodiment of FIG. 7.
Figure 10:
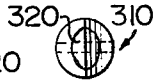
FIG. 10 is a front end view of the embodiment of FIG. 9.
Figure 12:
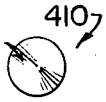
FIG. 12 is a front end view of the embodiment of FIG. 11.
Figure 14:
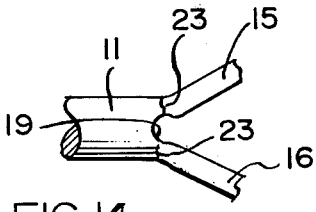
FIG. 14 is a fragmentary enlarged side elevation illustrating the spreading apart and fracture of the bifurcated nose end portions of the flechette resulting from the striking of a target.

Each of the different embodiments of FIGS. 5 through 12 are similar to the flechette 10 shown in FIGS. 1 through 4, and are identified by similar reference numerals except one hundred higher in the case of flechette 110 of FIGS. 5 and 6, two hundred higher in the case of flechette 210 of FIGS. 7 and 8, three hundred higher in the case of flechette 310 of FIGS. 9 and 10, and four hundred higher in the case of flechette 410 of FIGS. 11 and 12.

In each of the forms illustrated, the bifurcated nose end of the flechette is caused to spread apart whereby the prong portions thereof diverge from the longitudinal path of the elongated flechette member, thereby to define three separate wound channels in the target. The prong portions may be caused to separate from the main body of the flechette as a result of the diverging movement thereof whereby the flechette effectively defines a plurality of separate missile elements in the target. The wedging elements of flechettes 10, 110, 310 and 410 provide an aerodynamic nose portion for improved flight stability and provide sharp target penetrating means, while yet also providing means for effecting the spreading of the bifurcated nose end. The flechettes are extremely simple and economical of construction while yet providing the above described novel features.

While I have shown and described certain embodiments of my invention, it is to be understood that it is capable of many modifications. Changes, therefore, in the construction and arrangement may be made without departing from the spirit and scope of the invention as defined in the appended claims.

I claim:

1. A flechette comprising: an elongated, one-piece member having a penetrating nose end and a tail portion defining means for orienting said member in flight to present said nose end forwardly; and means for causing a spreading formation of said nose end as an incident of striking engagement thereof with a target comprising means dividing said nose end into a plurality of deflectable integrally joined prongs and means at the rear end of said dividing means weakening said member thereat to facilitate spreading deformation of said prongs.

2. The flechette of claim 1 wherein said nose end includes a forward sharp tip for promoting penetration of the target.

3. The flechette of claim 1 including means carried by said nose end for wedging said prongs apart as an incident of said striking engagement of the nose end with the target.

4. The flechette of claim 3 wherein said wedging means comprises a rearwardly narrowing, forwardly opening recess in the forward tip of said nose end.

5. The flechette of claim 3 wherein said wedging means comprises a rearwardly narrowing, forwardly opening recess in the forward tip of said nose end, and a wedge element in said recess for rearward, prong-spreading movement as an incident of the striking engagement of the nose end with the target.

6. The flechette of claim 4 including a body of filler material in said recess.

7. The flechette of claim 1 wherein said weakening means comprises a cavity in said member.

8. The flechette of claim 1 wherein said weakening means comprises a cavity in said member, and a body of filler material provided in said cavity.

9. The flechette of claim 1 including means carried by said nose end for wedging said prongs apart as an incident of said striking engagement of the nose end with the target, said wedging means comprising a rearwardly narrowing, forwardly opening recess in the forward tip of said nose end, and a wedge element in said recess for rearward, prong-spreading movement as an incident of the striking engagement of the nose end with the target, and a body of filler material in said slot.

10. The flechette of claim 1 including an element fixed to said nose end and defining a sharp forward tip extending forwardly from said member for promoting penetration of the target.

11. The flechette of claim 1 wherein said weakening means comprises a radial through bore.

12. The flechette of claim 1 wherein said weakening means is constructed to permit said prongs to separate from the elongated member upon a preselected penetration of the target thereby to provide a plurality of separate penetrations of the target.

13. The flechette of claim 1 including a body of material preselected to be injurious to the target upon contact therewith.

14. The flechette of claim 1 wherein said dividing means comprises a diametric slot in said nose end.

* * * * *